US006065715A

United States Patent [19]

Andersson

[11] Patent Number: 6,065,715

[45] Date of Patent: May 23, 2000

[54] EXPANDABLE SHAFT HAVING SPIRAL SHAPED PROJECTIONS AND IT'S USE FOR WINDING ELONGATED MATERIAL

[75] Inventor: Anders Andersson, Stenungsund, Sweden

[73] Assignee: SCA Hygiene Products AB, Gothenburg, Sweden

[21] Appl. No.: 08/648,054

[22] PCT Filed: Nov. 23, 1994

[86] PCT No.: PCT/SE94/01114

§ 371 Date: Aug. 1, 1996

§ 102(e) Date: Aug. 1, 1996

[87] PCT Pub. No.: WO95/14630

PCT Pub. Date: Jun. 1, 1995

[30] Foreign Application Priority Data

Nov. 26, 1993 [SE] Sweden ..... 9303924

[51] Int. Cl.[7] ..... B65H 75/24; B23B 5/22; B23Q 3/14

[52] U.S. Cl. ..... 242/571.1; 242/571.5; 279/2.08; 269/48.1

[58] Field of Search ..... 242/571, 571.1, 242/571.2, 571.4, 571.5; 279/2.07, 2.08, 2.21; 269/48.1

[56] References Cited

U.S. PATENT DOCUMENTS

| | | | |
|---|---|---|---|
| 452,854 | 5/1891 | Smith | 242/571.2 |
| 2,741,093 | 4/1956 | Riker | 242/571.2 X |
| 2,991,954 | 7/1961 | Lacey . | |
| 3,048,345 | 8/1962 | Willard | 242/571.1 |
| 3,391,878 | 7/1968 | Naccara | 242/571.1 |
| 3,596,847 | 8/1971 | Peterson | 242/571.1 |
| 3,863,857 | 2/1975 | Smith | 242/571.1 |
| 3,904,144 | 9/1975 | Gattrugeri | 242/571.2 |
| 3,937,412 | 2/1976 | Damour | 242/571.1 |
| 4,229,014 | 10/1980 | Crowe | 242/571.1 X |
| 4,436,252 | 3/1984 | Bürkle et al. | 242/571.1 |
| 4,840,323 | 6/1989 | Nakajima | 242/571.2 |
| 4,854,520 | 8/1989 | Gavin et al. | 242/571.1 X |
| 5,372,331 | 12/1994 | Miller et al. | 242/571.1 X |

FOREIGN PATENT DOCUMENTS

| | | | |
|---|---|---|---|
| 0 408 246 A2 | 1/1991 | European Pat. Off. . | |
| 124 827 | 6/1972 | Norway . | |
| 399 694 | 2/1978 | Sweden . | |
| 455 367 | 7/1988 | Sweden . | |
| 9203009 | 4/1994 | Sweden . | |
| 457 073 | 7/1968 | Switzerland . | |
| 897410 | 1/1982 | U.S.S.R. | 279/2.08 |
| 975232 | 11/1982 | U.S.S.R. | 279/2.08 |
| 1046035 | 10/1983 | U.S.S.R. | 279/2.08 |
| 1135563 | 1/1985 | U.S.S.R. | 279/2.08 |
| 1170649 | 11/1969 | United Kingdom | 242/571.1 |

*Primary Examiner*—Donald P. Walsh
*Assistant Examiner*—William A. Rivera
*Attorney, Agent, or Firm*—Burns, Doane, Swecker & Mathis, L.L.P.

[57] ABSTRACT

Expandable shaft for winding elongated material, especially soft paper and other nonwoven material. The shaft (10) has a number of radial openings (13) or grooves (22, 24) which house longitudinal blades (23), bars (11) or the like in such a way that these are movable by means of activating means (14, 15, 25) in a radial direction between a retracted and a projected position, whereby a variable effective diameter of the shaft is created. The radial openings (13) or grooves (22, 24) are arranged with a spiral formed inclination in the longitudinal direction of the shaft (10) and the retractable and projectable blades (23) or the bars (11) housed therein are arranged with a corresponding spiral form along the shaft.

9 Claims, 3 Drawing Sheets

EXPANDABLE SHAFT HAVING SPIRAL SHAPED PROJECTIONS AND IT'S USE FOR WINDING ELONGATED MATERIAL

TECHNICAL FIELD

The present invention relates to an expandable shaft for winding elongated material, especially soft paper and other nonwoven material, which shaft has a number of radial openings or grooves which house elongated blades, bars or the like in such a way that these are movable in a radial direction between a retracted and a projected position, thereby bringing about a variable effective diameter of the shaft which also includes activating means within the shaft to bring about the radial movement of the blades or the bars between the retracted and projected positions.

BACKGROUND OF THE INVENTION

Rolls of toilet-paper, kitchen rolls or rolls of cleaning material for large consumer purposes are usually produced by rolling the paper on a thin tube-shaped core, usually a sleeve of cardboard. This cardboard sleeve usually adds extra cost to the production of paper-rolls and, in addition, it is left over when the paper has been consumed and must be discarded.

Paper-rolls without cores where the paper is drawn out from the centre of the roll are known earlier from for instance SE-B-399 694. To avoid collapse of the hole at the centre according to this publication it is proposed that the innermost paper turns are fixed to each other by means of water having optionally an addition of a binder. In this manner, a reinforcing core is made from the innermost turns which, however, are not completely glued to each other and can be rolled off together with the rest of the paper strip and used as the rest thereof. The winding of the paper strip occurs on an expandable winding shaft which after the winding, is contracted so that it can easily be removed from the thus formed paper-roll.

One example of an expandable winding shaft of said kind is shown in EP-A-0 408 246.

From SE-B-455 367 a coreless toilet paper-roll is known from which the paper can be rolled off from the periphery of the roll. The winding shaft has a relatively small diameter, approximately 10–15 mm, and has a polygonal or a cog wheel resembling section form, whereby the centre hole, which is formed when the paper strip is wound on the shaft and this has been removed, will have alternating radially outwardly directed pressure grooves and inwardly arched parts. The winding shaft is solid, that means not expandable, and its corners or cogs can possibly be helically shaped along the shaft to describe a good vicious circle and to avoid noise during the winding up on a so called supporting roller machine. Due to its small diameter the shaft can be removed without substantial problems from the paper-roll after the winding has terminated.

THE OBJECTS OF THE INVENTION AND MAIN FEATURES

The object of the present invention is to bring about an expandable winding shaft of the kind mentioned in the preamble which can be used for paper-rolls of any dimension and diameter of the centre hole. The winding shaft should further bring about a certain reinforcing of the centre hole in the paper roll so that the need for a further reinforcement such as humidifying is reduced or can even be eliminated.

This has been attained by arranging the radial openings or grooves as a spiral shaped inclination in the longitudinal direction of the shaft and that the retractable and projectable blades or bars therein are arranged with a corresponding spiral shape along the shaft.

The invention includes further use of the winding shaft for winding elongated material, especially soft paper or other nonwoven material.

DESCRIPTION OF DRAWINGS

The invention will in the following be described in more detail in connection with some embodiment examples shown in the attached drawings.

DESCRIPTION OF EMBODIMENT EXAMPLES

Figure 1:
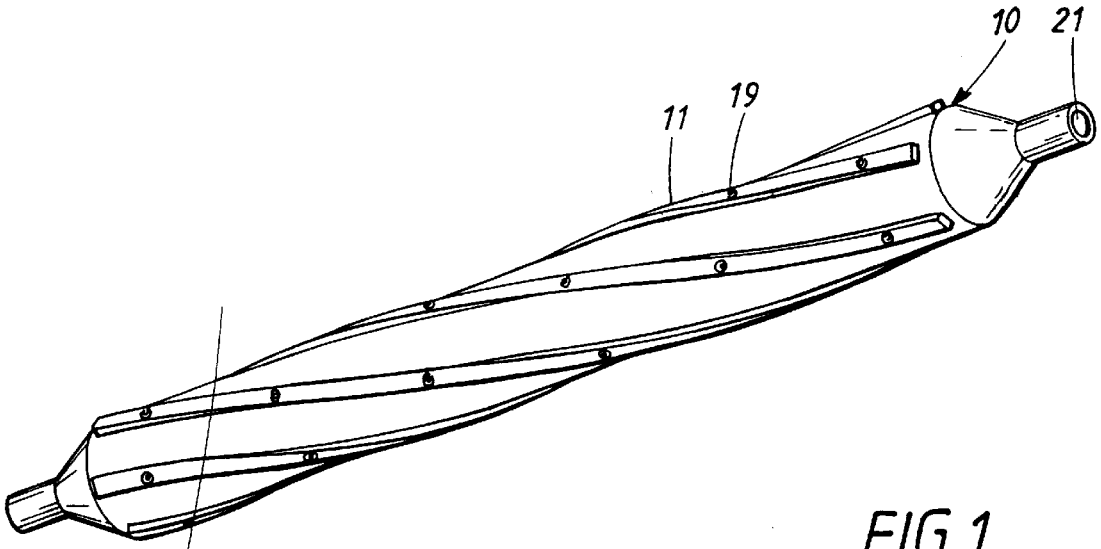
FIG. 1 shows in perspective a winding shaft having spiral formed twisted bars.
Figure 2A:
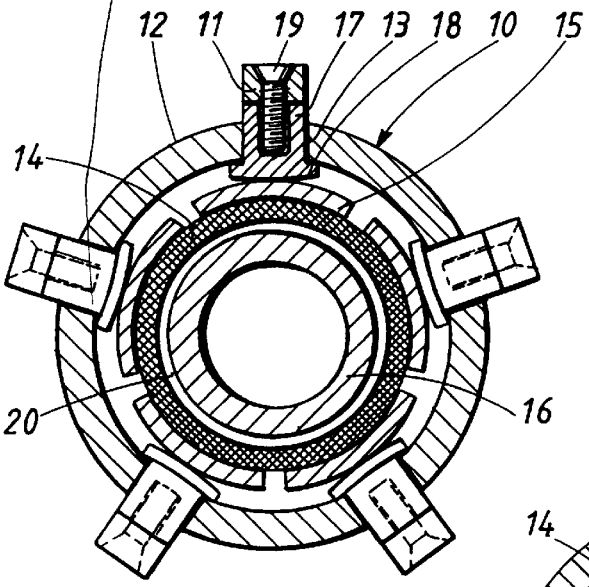
FIGS. 2*a* & *b* are sections of a first embodiment of an expandable shaft in the projected and retracted position respectively.
Figure 2B:
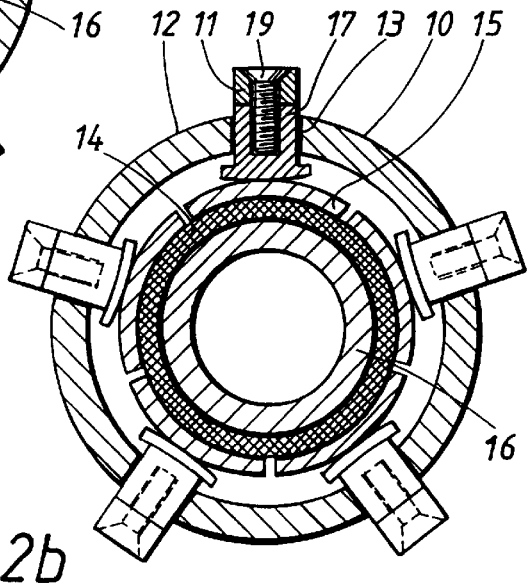

The winding shaft 10 according to FIG. 1 has a number, preferably at least four, of spiral shaped twisted longitudinal bars 11, which are retractable and projectable in some of the ways which appear from the following figures. With reference to FIGS. 2*a* and *b*, the shaft 10 is hollow and has an outer tube 12 provided with a number of bored holes along the periphery. The holes 13 are arranged in rows at a certain distance from each other and with a spiral formed inclination. Within the outer pipe 12 an expandable bulb 14 has been arranged, at the outer side of which longitudinal segments 15 of a rigid material have been arranged. The segments 15 have the same spiral formed inclination as the holes 13, which are arranged in rows in the outer tube 12 and are arranged in front of these. The outer tube 12 and the segments 15 are non-rotatably connected to each other. Within the bulb 14 an inner tube 16 has been arranged, against which the bulb 14 retracts in the retracted position according to FIG. 2*b*.

In the holes 13 in the outer tube 12 pins 17 have been slidably inserted, which pins have a supporting surface 18 which abuts against the segments 15. Against the pins 17 bars 11 have been screwed 19, which extend along the outer tube 12 with the same spiral formed inclination as the hole rows 13. The bars 11 can possibly consist of shorter lengths which are joined in connection with the mounting.

The bulb 14 is made to expand by means of compressed air which is fed to the space 20 between the bulb 14 and the inner tube 16 via a support pipe 21. When the bulb 14 expands the bars 11 will, via the segments 15 and the tops 17 cooperating with these, be pushed radially outwards to their projected positions shown in FIG. 2*a* which is maintained during the winding of the elongated material. After winding is terminated the bulb 14 is emptied of compressed air so that it will retract to the initial position shown in FIG. 2*b* at which the bars 11 are in their retracted position and the effective diameter of the shaft 10 has been reduced so that the roll of elongated material can easily be removed from the shaft 10. The removal occurs through a twisting movement of the shaft 10.

Figure 3A:
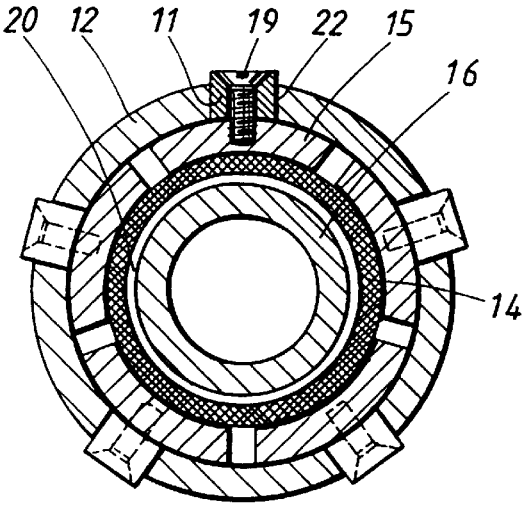
FIGS. 3*a* & *b* are sections of another embodiment of the invention.
Figure 3B:
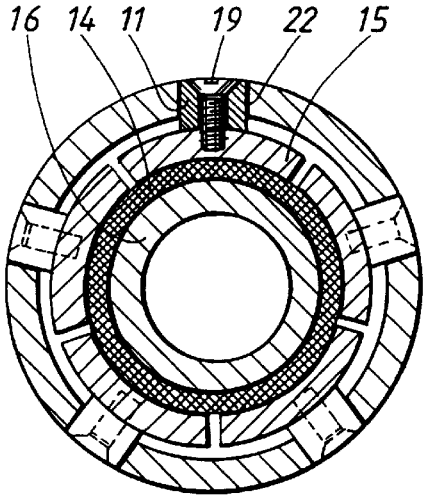

The embodiment according to the FIGS. 3*a* and *b* differs from the above-described in that the outer tube 12 has longitudinally spiral formed twisted slots 22 arranged opposite the segments 15 and have the same inclination as them. The bars 11 are in this case screwed 19 directly against the segments 15. In their retracted position, FIG. 3*b*, the bars 11 are retracted completely in the slots 22, so that the shaft 10 obtains a smooth surface which facilitates the removal of the material roll from the shaft.

Figure 4A:
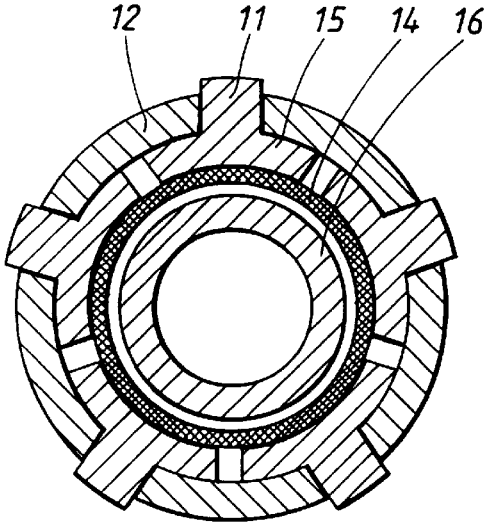
FIGS. 4*a* & *b* are sections of a third embodiment of the invention.
Figure 4B:
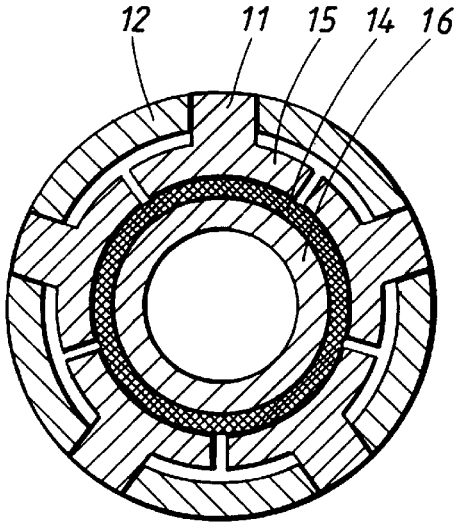

In the embodiment shown in FIGS. 4*a* and *b* the bars 11 have been formed in one piece with the segments 15. In other aspects this embodiment will function in a way corresponding to the one described above.

Figure 5A:
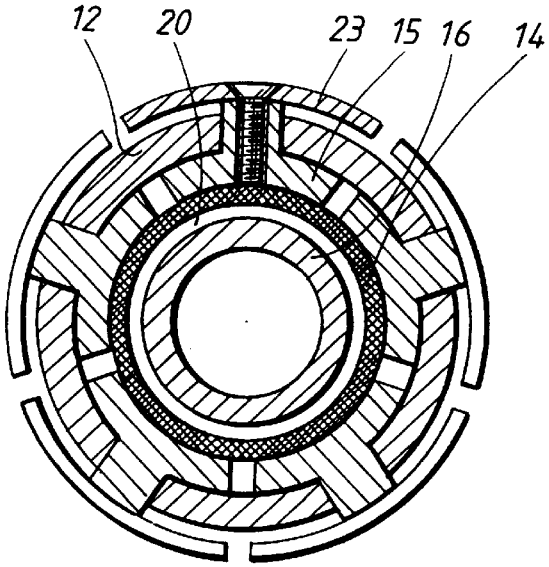
FIGS. 5*a* & *b* are sections of a fourth embodiment of the invention.
Figure 5B:
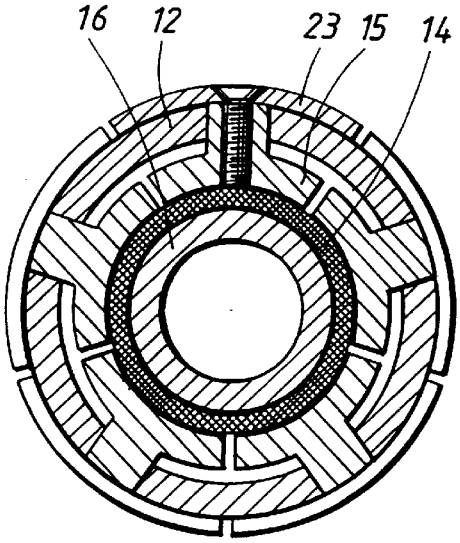

The embodiment according to FIGS. 5*a* and *b* differs from the one shown in FIGS. 4*a* and *b* in that the bars 11 have been provided with blade-shaped parts 23 which have a curvature corresponding to that of the outer tube 12.

Figure 6A:
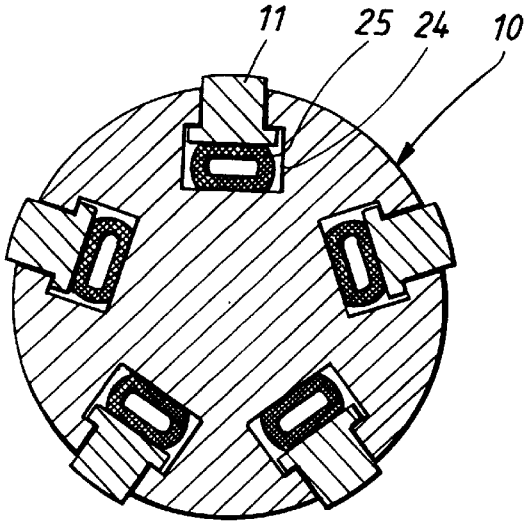
FIGS. 6*a* & *b* are sections of a fifth embodiment of the invention.
Figure 6B:
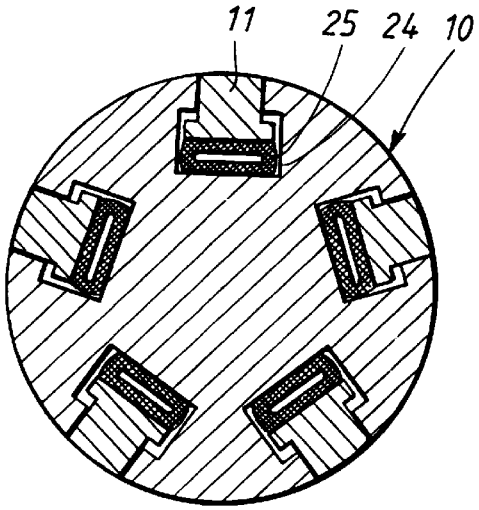

In the embodiment according to FIGS. 6*a* and *b* the shaft 10 comprises a rod which has a number of grooves 24 which extend with spiral form along the rod. In the example shown the grooves have a substantially T-formed section. In the bottom of each groove 24 an expandable bulb 25 has been arranged and connected to a compressed air aggregate (not shown). The bars 11, having an inclination corresponding to that of the groove 24, are further arranged in the groove 24 and fixed to the respective bulb 25. In the expanded position of the bulbs 25, FIG. 2*a*, the bars 11 will protrude outside the periphery of the shaft 10 whereas in their contracted position (FIG. 2*b*) they are completely accommodated in the grooves 24. Each bar 11 can possibly consist of several parts which are joined before or during the mounting.

In all embodiments, the twisted shape of the components included in the shaft 10 can for example be obtained by extrusion with a continuous casting tool which has the desired spiral formed twisted shape. A suitable material for the outer tube 12, the segments 15 and the bars 11 is a so-called composite material which gives higher precision and allows simpler production than metal.

The spiral formed twisted expandable shaft 10 can be used for winding elongated material especially soft paper and other nonwoven material both on so-called support roller machines in which the winding shaft is arranged between a pair of supporting rollers which rotate and on centrally driven rolling machines in which the winding shaft itself rotates. In both types of rolling machines the paper will be wound up on the shaft when this is rotated whereupon after winding is terminated, the shaft is removed from the thus formed paper roll. During the winding the shaft is in its expanded position, whereby the spiral formed twisted bars 11 or blades 23 will provide a central hole in the paper roll having radial impressions which extend spiral formed along this centre hole. These impressions reinforce the central hole and prevents it collapsing. The spiral form of the impressions further increases the stiffening effect.

To further stiffen the central hole a humidification of the innermost turns of the paper strip can occur in a known way, for example by means of a nozzle. The need for humidification is however reduced and can possibly be completely eliminated due to the stiffening of the central hole that can be obtained through the spiral formed twisted bars or blades.

The invention is naturally not limited to the embodiment examples shown but can be varied within the scope of the patent claims. Thus, the expanding of the shaft can for example be carried out in a mechanical way, for example through a cam mechanism.

I claim:

1. An expandable shaft for winding elongated material, comprising:

a number of radial openings, longitudinal bars housed in the radial openings in such a way that the bars are movable in a radial direction between a retracted position and a projected position, thereby bringing about a variable effective diameter of the shaft, activating means arranged within the shaft to bring about the radial movement of the bars between the retracted position and the projected position, the radial openings are arranged with a spiral formed inclination in a longitudinal direction of the shaft, the retractable and projectable bars housed therein are arranged with a corresponding spiral form along the shaft, and said bars, when in a projected position, are designed to impart radial impressions, extending in a spiral form along a centre hole of a material roll formed around the shaft.

2. The expandable shaft according to claim 1, wherein the shaft further comprises an outer tube having said radial openings and activating means arranged therein and further having segments arranged opposite said openings and with a spiral formed inclination corresponding thereto, and which segments cooperate with the bars housed in the openings.

3. The expandable shaft according to claim 2, wherein the bars are connected to pins which are received in said radial openings and which cooperate with the segments.

4. The expandable shaft according to claim 2, wherein the outer tube has radial grooves and that the bars are housed in the grooves and are connected to said segments.

5. The expandable shaft according to claim 2, wherein the bars are formed in one piece with the segments.

6. The expandable shaft according to claim 1, wherein in the bottom of said openings the activating means are arranged which co-operate with the bars received in the openings.

7. The expandable shaft according to claim 1, wherein the activating means includes a single element arranged in a central part of the shaft for simultaneously and uniformly projecting the bars.

8. The expandable shaft according to claim 7, wherein the activating means is cylindrical in shape and is concentrically arranged within the tube.

9. A method of using the expandable shaft of claim 1 for winding an elongated material, comprising the steps of:

projecting the bars into the projected position;

winding the elongated material on the shaft while the bars are in the projected position;

forming spiral impressions in a central hole of a roll of the material formed on the shaft, which spiral impressions remain after retraction of the bars to the retracted position;

retracting the bars to the retracted position; and withdrawing the shaft from the roll.

* * * * *